US006310431B1

(12) United States Patent
Blanchet-Fincher et al.

(10) Patent No.: US 6,310,431 B1
(45) **Date of Patent: *Oct. 30, 2001**

(54) ANNEALED CARBON SOOT FIELD EMITTERS AND FIELD EMITTER CATHODES MADE THEREFROM

(75) Inventors: Graciela Beatriz Blanchet-Fincher, Greenville; William Leo Holstein; Syed Ismat Ullah Shah, both of Wilmington; Shekhar Subramoney, Hockessin, all of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/068,483

(22) PCT Filed: Nov. 13, 1996

(86) PCT No.: PCT/US96/18146

§ 371 Date: May 12, 1998

§ 102(e) Date: May 12, 1998

(87) PCT Pub. No.: WO97/18575

PCT Pub. Date: May 22, 1997

Related U.S. Application Data

(60) Provisional application No. 60/006,776, filed on Nov. 15, 1995.

(51) Int. Cl.[7] ..... H01J 1/30

(52) U.S. Cl. ..... 313/311; 313/310; 313/346 R

(58) Field of Search ..... 313/311, 310, 313/346 R, 495

(56) References Cited

U.S. PATENT DOCUMENTS

| | | | | |
|---|---|---|---|---|
| 4,857,799 | | 8/1989 | Spindt et al. | 313/495 |
| 5,015,912 | | 5/1991 | Spindt et al. | 313/495 |
| 5,199,918 | | 4/1993 | Kumar | 445/50 |
| 5,944,573 | * | 8/1999 | Mearini et al. | 445/50 |

FOREIGN PATENT DOCUMENTS

| | | |
|---|---|---|
| 44 05 768 A1 | 8/1995 | (DE) . |
| WO 94 15350 | 7/1994 | (WO) . |
| WO 94 15352 | 7/1994 | (WO) . |
| WO 94 28571 | 12/1994 | (WO) . |
| WO 95 22169 | 8/1995 | (WO) . |
| WO 97 18577 | 5/1997 | (WO) . |

OTHER PUBLICATIONS

D. Urgate, High–Temperature Behaviour of "Fullerene Black", *Carbon,* vol. 32, No. 7, 1245–1248, Dec. 1994.

W. S. Basca et al., Raman Spectroscopy of Closed–Shell Carbon Particles, *Chemical Physics Letters,* vol. 211, Nos. 4, 5, 346–352, Aug. 20, 1993.

L. A. Chernozatonskii, et al., Electron Field Emission From Nanofilament Carbon Films, *Chemical Physics Letters,* 233, 63–68, Feb. 3, 1995.

Chernozatonskii et al., Nanotube Carbon Structure Tips—A Source of High Field Emission of Electrons, *Mat. Res. Soc. Symp. Proc.,* 359, 99–104, Dec. 1995.

B. H. Fishbine et al., Buckytube Cold Field Emitter Array Cathode Experiments, *Mat. Res. Soc. Symp. Proc.,* 359, 93–98, Dec. 1995.

Walt A. de Heer et al., Carbon Onions Produced By Heat Treatment of Carbon Soot and Their Relation To The 217.5 nm Interstellar Absorption Feature, *Chemical Physics Letters,* 207, 480–486, May 28, 1993.

Kratschmer et al., Solid C60: A New Form of Carbon, *Nature,* vol. 347, 354–358, Sep. 27, 1990.

Davanloo et al., Laser Plasma Diamond, *J. Mater. Res.,* vol. 5, No. 11, 2398–2404, Nov., 1990.

* cited by examiner

*Primary Examiner*—Ashok Patel

(57) ABSTRACT

Annealed carbon soot is useful as an electron field emitter. Field emitting cathodes made up of annealed carbon soot attached to the surface of a substrate are also provided. The field emitters and field emitter cathodes are useful in vacuum electronic devices, flat panel computer and television displays, emission gate amplifiers, klystrons and lighting devices.

11 Claims, 11 Drawing Sheets

50nm

10nm

ANNEALED CARBON SOOT FIELD EMITTERS AND FIELD EMITTER CATHODES MADE THEREFROM

CROSS-REFERENCE TO RELATED APPLICATIONS

This application claims the benefit of continuation of U.S. Provisional Application 60/006,776, filed Nov. 15, 1995 and PCT International Application PCT/US96/18146, filed Nov. 13, 1996, wherein the United States was a designated country.

FIELD OF THE INVENTION

The invention generally relates to the use of annealed carbon soot as an electron field emitter and particularly to its use in making a field emitter cathode.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, klystrons and lighting devices.

Display screens are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently laptop computer flat panel displays use liquid crystals which can be switched from a transparent state to an opaque state by the application of small electrical signals. It is difficult to reliably produce these displays in sizes larger than that suitable for laptop computers.

Plasma displays have been proposed as an alternative to liquid crystal displays. A plasma display uses tiny pixel cells of electrically charged gases to produce an image and requires relatively large electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth, weight and power consumption advantages of the other flat panel displays. U.S. Pat. Nos. 4,857,799 and 5,015,912 disclose matrix-addressed flat panel displays using micro-tip cathodes constructed of tungsten, molybdenum or silicon. WO 94-15352, WO 94-15350 and WO 94-28571 disclose flat panel displays wherein the cathodes have relatively flat emission surfaces.

Field emission has been observed in two kinds of nanotube carbon structures. L. A. Chernozatonskii et al., Chem. Phys. Letters 233, 63 (1995) and Mat. Res. Soc. Symp. Proc. Vol. 359, 99 (1995) have produced films of nanotube carbon structures on various substrates by the electron evaporation of graphite in $10^{-5}$–$10^{-6}$ Torr. These films consist of aligned tube-like carbon molecules standing next to one another. Two types of tube-like molecules are formed; the A-tubelites whose structure includes single-layer graphite-like tubules forming filaments-bundles 10–30 nm in diameter and the B-tubelites, including mostly multilayer graphite-like tubes 10–30 nm in diameter with conoid or dome-like caps. They report considerable field electron emission from the surface of these structures and attribute it to the high concentration of the field at the nano-dimensional tips. B. H. Fishbine et al., Mat. Res. Soc. Symp. Proc. Vol. 359, 93 (1995) discuss experiments and theory directed towards the development of a buckytube (i.e., a carbon nanotube) cold field emitter array cathode.

W. A. de Heer & D. Ugarte, Chem. Phys. Letters 207, 480 (1993) and D. Ugarte, Carbon 32, 1245 (1994) discuss the production and heat treatment of carbon soot. Fullerenes are produced by the condensation of electric-arc-produced carbon vapor in a low pressure atmosphere. The fullerenes produced are soluble and easily removed from the soot. The soot is then subjected to a heat treatment and at temperatures of above 2000° C. small closed shell particles are formed. These onion-like particles are hollow polyhedral particles with walls consisting of 2 to about 8 carbon basal plane layers.

What are needed are additional and/or improved field emitting materials suitable for use in field emitter cathodes which are, in turn, useful in display panels and other electronic devices. Other objects and advantages of the invention will become apparent to those skilled in the art upon reference to the figures and the detailed description of the invention which hereinafter follows.

SUMMARY OF THE INVENTION

The present invention provides an electron field emitter comprised of annealed carbon soot, i.e., carbon soot which has been heated to temperatures of at least about 2000° C., preferably at least about 2500° C., and most preferably at least about 2850° C., in an inert atmosphere. During heating, this temperature is preferably maintained for at least about 5 minutes.

The invention also provides for field emitter cathodes comprised of annealed carbon soot attached to the surface of a substrate.

Annealed carbon soot field emitters and field emitter cathodes made therefrom are useful in vacuum electronic devices, flat panel computer and television displays, emission gate amplifiers, klystrons and lighting devices. The display panels can be planar or curved.

DETAILED DESCRIPTION OF THE PREFERRED EMBODIMENTS

The present invention provides a novel electron field emitter, annealed carbon soot, and an electron field emitter cathode comprised of annealed carbon soot attached to a substrate.

As used herein, "diamond-like-carbon" means that the carbon possesses appropriate short range order, i.e., a suitable combination of $sp^2$ and $sp^3$ bonding may also provide for field emission materials with high current densities. By "short range order" is generally meant an ordered arrangement of atoms less than about 10 nanometers (nm) in any dimension.

Carbon soot can be generated by the condensation of electric-arc produced carbon vapor in a low pressure inert atmosphere as described in Kratschmer et al., Nature (London) 347, 354 (1990), W. A. de Heer & D. Ugarte, Chem. Phys. Letters 207, 480 (1993) and D. Ugarte, Carbon 32, 1245 (1994).

The carbon soot used in the examples of the invention was typically prepared in a controlled pressure reaction chamber containing two carbon electrodes. The diameter of the cathode was from about 9 mm to about 13 mm and the anode was from about 6 mm to about 8 mm (the cathode diameter should always larger than the anode diameter). Inert gas such as helium or argon was passed through the chamber and the pressure was held constant at a level from about 100 torr to about 1000 torr. The electric current between the electrodes depended on the electrode diameters, the gap distance between the electrodes, and the inert gas pressure. The current was typically between 50 A and 125 A. A computer-controlled motor was used to adjust the position of the anode relative to the cathode to establish a gap distance of 1 mm. During the arc-discharge process the anode was continually consumed. Carbon was deposited on the cathode and large amounts of soot were deposited on the walls of the reaction vessel and on the filter arranged to trap and collect the soot before it was transported to the pump with the inert gas. Soot was collected from the filter and the walls and fullerenes, such as $C_{60}$ and $C_{70}$, were extracted from the collected soot by solvents such as toluene or benzene.

Figure 1:
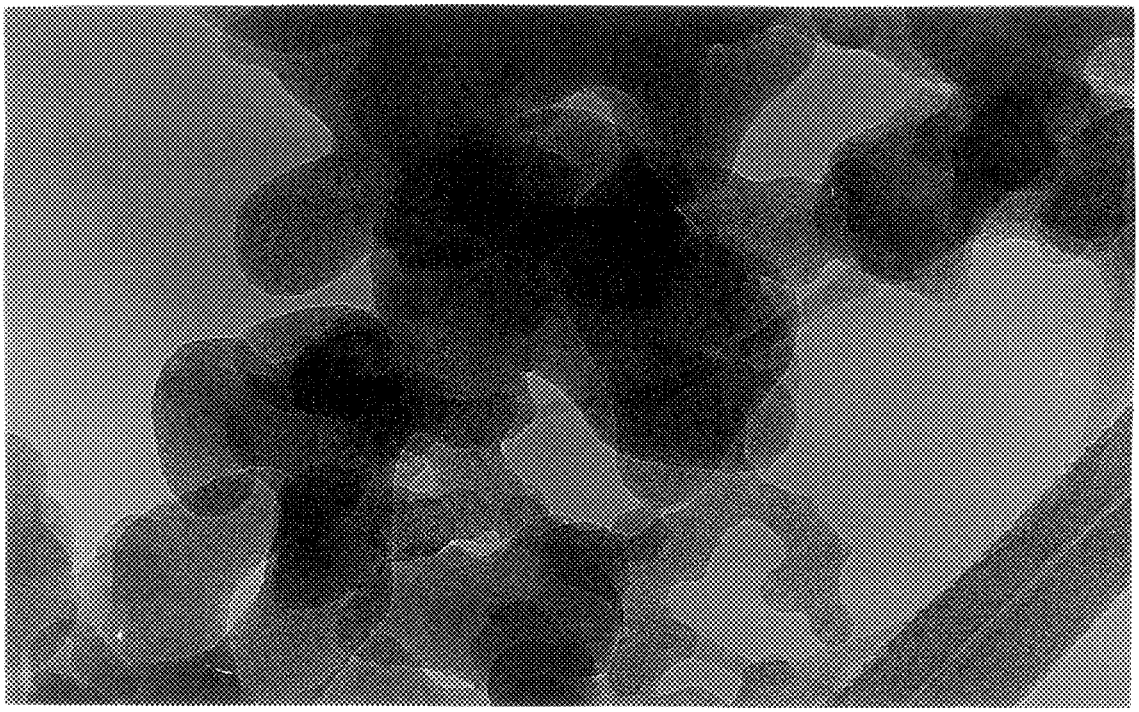
FIG. 1 is a transmission electron microscopy (TEM) image of unannealed carbon soot.
Figure 2:
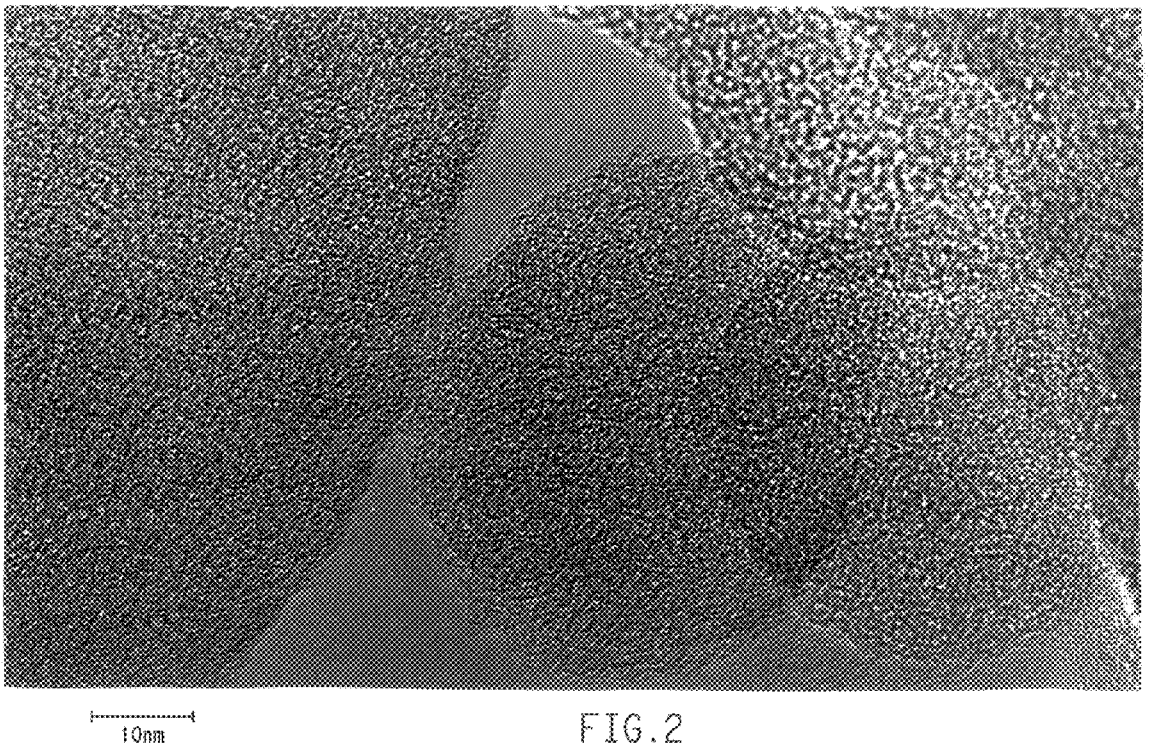
FIG. 2 is a high resolution electron microscopy image of unannealed carbon soot that shows its "cotton-ball" appearance.

As shown in FIG. 1, transmission electron microscopy (TEM) results show that the carbon soot so obtained had an amorphous structure with particle sizes typically in the range of about 50–100 nm. As shown in FIG. 2, high resolution electron microscopy shows the "cotton-ball" appearance of the carbon soot. The material was highly disordered with only short range order of the carbon basal planes.

Thereafter, the carbon soot was annealed to produce the annealed carbon soot of the invention which is useful as an electron field emitter. The carbon soot was heated at high temperatures in an inert atmosphere to produce the desired change in structure and properties. Annealing at temperatures of 2000° C. to 2400° C. is described by W. A. de Heer & D. Ugarte, Chem. Phys. Letters 207, 480 (1993) and D. Ugarte, Carbon 32, 1245 (1994). The carbon soot was heated to temperatures of at least about 2000° C., preferably at least about 2500° C., and most preferably at least about 2850° C., in an inert atmosphere such as argon or helium. This temperature was maintained for at least about 5 minutes. Temperatures up to about 3000° C. can be used although higher temperatures may be impractical and are thus less preferred (e.g., loss of material due to evaporation). The carbon soot can also be heated to an intermediate temperature and maintained at that temperature to form a glassy material before raising the temperature to the highest temperature.

Figure 3:
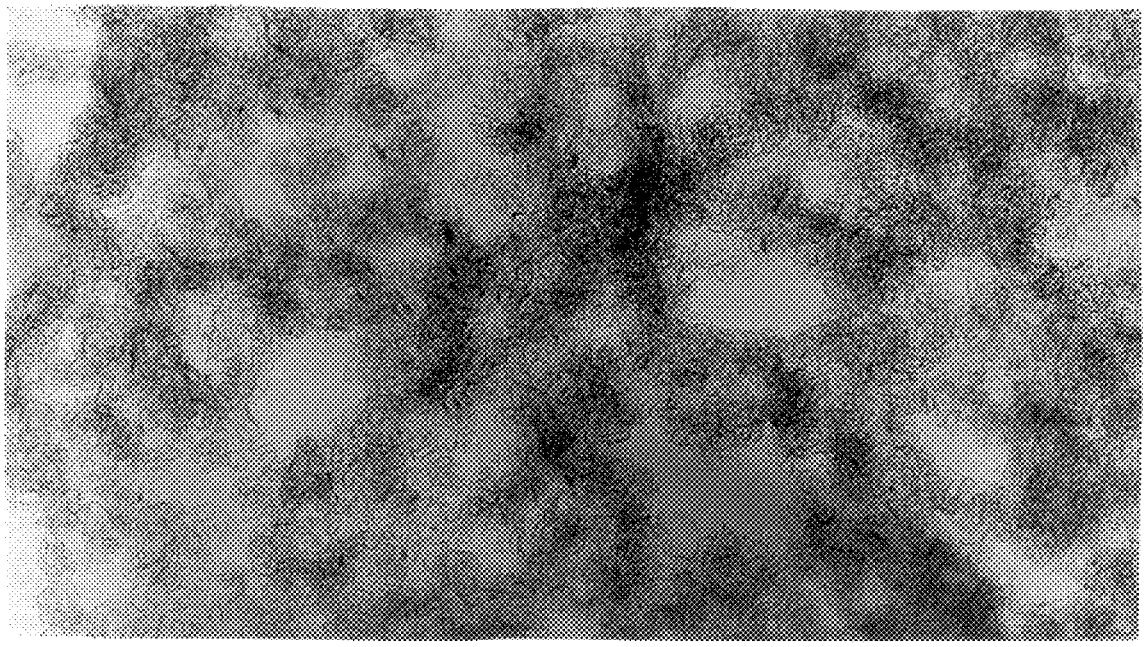
FIG. 3 is a low-magnification bright-field transmission electron microscopy (TEM) image of annealed carbon soot showing the uniform appearance of the polyhedral particles.
Figure 4:
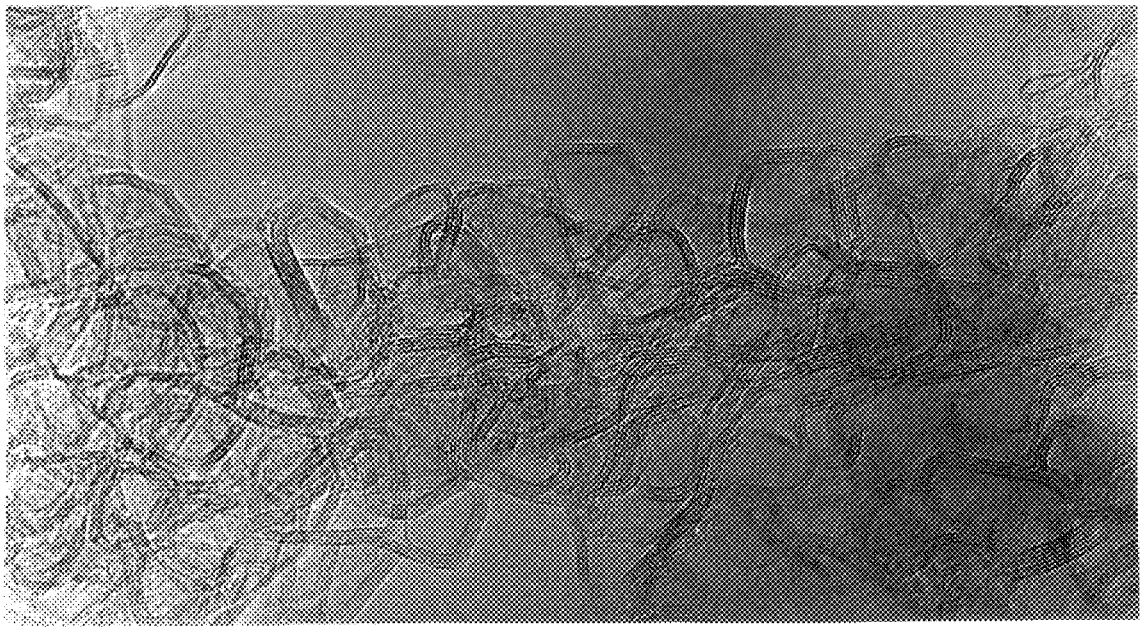
FIG. 4 is a high resolution electron microscopy image of annealed carbon soot that shows that each polyhedral particle consists of wails of 2–5 layers of basal-plane carbon surrounding an empty central cavity.

The emissive properties of the annealed carbon soot were determined primarily by the highest temperature of the annealing treatment and by the time at that temperature. Annealing causes a substantial change in the microstructure of the carbon soot. It produces highly ordered polyhedral nanoparticles about 5 nm to about 15 nm in size which may be mixed with larger particles of 1–5 microns in size. The polyhedral nanoparticles are uniform in appearance as shown in the low-magnification bright-field TEM image of FIG. 3. In FIG. 4, high resolution electron microscopy shows that each polyhedral particle consists of walls of 2–5 layers of basal plane carbon surrounding an empty central cavity.

Field emission tests were carried out on the annealed carbon soot using a flat-plate emission measurement unit comprised of two electrodes, one serving as the anode or collector and the other serving as the cathode. This will be referred to in the Examples as Measurement Unit I. The unit was comprised of two square copper plates, 1.5 in by 1.5 in (3.8 cm×3.8 cm), with all corners and edges rounded to minimize electrical arcing. Each copper plate was embedded in a separate polytetrafluoroethylene (PTFE) block, 2.5 in×2.5 in (4.3 cm×4.3 cm), with one 1.5 in by 1.5 in (3.8 cm×3.8 cm) copper plate surface exposed on the front side of the PTFE block. Electrical contact to the copper plate was made by a metal screw through the back of the PTFE block and extending into the copper plate, thereby providing a means to apply an electrical voltage to the plate and means to hold the copper plate firmly in place. The two PTFE blocks were positioned with the two exposed copper plate surfaces facing one another and in register with the distance between the plates fixed by means of glass spacers placed between the PTFE blocks but distanced from the copper plates to avoid surface leakage currents or arcing. The separation distance between the electrodes can be adjusted, but once chosen, it was fixed for a given set of measurements on a sample. Typically, separations of 0.04 cm to about 0.2 cm were used.

In order to measure the emission properties of a sample of the annealed carbon soot, the annealed carbon soot was attached to an electrically conducting substrate and the substrate was placed on the copper plate serving as the cathode. A negative voltage was applied to the cathode and the emission current was measured as a function of the applied voltage. Since the separation distance between the plates d and the voltage V were measured, the electric field E could be calculated (E=V/d) and the current could be plotted as a function of the electric field. In order to conveniently and rapidly measure the emission properties of annealed carbon soot, the annealed carbon soot was placed on the adhesive side of copper tape and two additional pieces of conducting copper tape were used to hold down the copper tape on the cathode plate with the adhesive side of the copper tape containing the annealed carbon soot facing the anode.

Field emission tests on samples of annealed carbon soot were carried out using a flat-plate emission measurement unit comprised of two electrodes, one serving as the anode or collector and the other serving as the cathode (referred to in the Examples as Measurement Unit II). The two electrodes, copper plates 1.5 in×1 in×⅛ in (3.8 cm×2.5 cm×0.32 cm), were separated by ceramic insulator spacers. The thickness of the insulators determines the distance or gap between the electrodes and spacers of thicknesses from about 0.055 cm to about 1.0 cm were available. Electrical contacts with the electrodes were made with screws at the backs of the electrodes. In order to measure the emission properties of a sample of the annealed carbon soot, the annealed carbon soot was attached to an electrically conducting substrate and the substrate was placed on the copper plate serving as the cathode. A negative voltage was applied to the cathode and the emission current was measured as a function of the applied voltage using an ammeter connected to the anode. Since the separation distance between the plates d and the voltage V was measured, the electric field E could be calculated (E=V/d) and the current could be plotted as a function of the electric field.

Another emission measurement unit (referred to in the Examples as Measurement Unit III) was used when wires or fibers were employed as the substrate. Electron emission from wires having attached diamond powder particles was measured in a cylindrical test fixture. In this fixture, the conducting wire to be tested (cathode) was mounted in the center of a cylinder (anode). This anode cylinder typically consisted of a fine mesh cylindrical metal screen coated with a phosphor. Both the cathode and anode were held in place by an aluminum block with a semi-cylindrical hole cut therein.

The conducting wire was held in place by two 1/16 inch-diameter stainless steel tubes, one at each end. These tubes were cut open at each end, forming an open trough in the shape of a half cylinder of length ½ inch and diameter 1/16 inch, and the wire was placed in the open trough that results and held in place with silver paste. The connecting tubes, were held in place within the aluminum block by tight fitting polytetrafluoroethylene (PTFE) spacers, which served to electrically separate the anode and cathode. The total length of exposed wire was generally set at 1.0 cm, although shorter or longer lengths could be studied by controlling the placement of the holder tubes. The cylindrical screen mesh cathode was placed in the semi-cylindrical trough in the-aluminum block and held in place with copper tape. The cathode was in electrical contact with the aluminum block.

Electrical leads were connected to both the anode and cathode. The anode was maintained at ground potential (0 V) and the voltage of the cathode was controlled with a 0–10 kV power supply. Electrical current emitted by the cathode was collected at the anode and measured with an electrometer. The electrometer was protected from damaging current spikes by an in-series 1 MΩ resistor and in-parallel diodes which allowed high current spikes to bypass the electrometer to ground.

Samples for measurement of length about 2 cm were cut from longer lengths of processed wires. With the flexible stainless steel screen with phosphor removed, they were inserted into the cylindrical troughs of the two holder arms. Silver paste was applied to hold them in paste. The silver paste was allowed to dry and the phosphor screen was reattached and held in place with copper tape at the two ends. The test apparatus was inserted into a vacuum system, and the system was evacuated to a base pressure below $3\times10^{-6}$ torr.

Emission current was measured as a function of applied voltage. Electrons emitted from the cathode create light when they stroke the phosphor on the anode. The distribution and intensity of electron emission sites on the coated wire were observed by the pattern of light created on the phosphor/wire mesh screen. The average electric field E at the wire surface was calculated through the relationship E=V/[a ln (b/a)], where V was the voltage difference between the anode and cathode, a was the wire radius, and b was the radius of the cylindrical wire mesh screen.

Typically, the annealed carbon soot was attached to the surface of an electrically conducting substrate to form a field emitter cathode. The substrate may be of any shape, e.g., a plane, a fiber, a metal wire, etc. Suitable metal wires include nickel, copper and tungsten. The means of attachment must withstand and maintain its integrity under the conditions of manufacturing the apparatus into which the field emitter cathode is placed, and under the conditions surrounding its use, e.g., typically vacuum conditions and temperatures up to about 450° C. As a result, organic materials are not generally applicable for attaching the particles to the substrate and the poor adhesion of many inorganic materials to carbon further limits the choice of materials that can be used.

The annealed carbon soot can be attached to a substrate by creating a thin metal layer of a conducting metal, such as gold or silver, on the substrate with the annealed carbon soot particles embedded in the thin metal layer. The thin metal layer anchors the annealed carbon soot particles to the substrate. In order for an annealed carbon soot particle to be effective as an electron emitter, it is necessary to have at least one surface of the particle exposed, i.e., be free of metal and protrude from the thin metal layer. The surface should be comprised of the surfaces of an array of annealed carbon soot particles with the metal filling the interstices between the particles. The quantity of annealed carbon soot particles and the thickness of the metal layer must be chosen to promote the formation of such a surface. In addition to providing means to attach the annealed carbon soot particles to the substrate, the conducting metal layer also provides means to apply a voltage to the annealed carbon soot particles.

A process for accomplishing this result comprises depositing a solution of a metal compound in a solvent and the annealed carbon soot particles onto the surface of a substrate. The solution can be applied to the surface first and the annealed carbon soot particles then deposited or the annealed carbon soot particles can be dispersed in the solution which is then applied to the substrate surface. The metal compound is one which is readily reduced to the metal, e.g., silver nitrate, silver chloride, silver bromide, silver iodide and gold chloride. Additional description of this process is provided in provisional Application No. 60/006,747 entitled "Process For Making A Field Emitter Cathode Using A Particulate Field Emitter Material" filed simultaneously herewith, the contents of which are incorporated herein by reference.

In many instances it will be desirable to increase the viscosity of the solution by adding an organic binder material so that the solution readily remains on the substrate. Examples of such viscosity modifiers include polyethylene oxide, polyvinyl alcohol and nitrocellulose.

The substrate with the solution and the annealed carbon soot particles deposited on it is then heated to reduce the metal compound to the metal. When an organic binder material is used it is boiled away (decomposed) during such heating. The temperature and the time of heating are chosen to result in the complete reduction of the metal compound. Typically, reduction is carried out at temperatures from about 120° C. to about 220° C. A reducing atmosphere or air can be used. Typically, the reducing atmosphere used is a 98% argon and 2% hydrogen mixture and the gas pressure is about 5–10 psi ($3.5–7\times10^4$ Pa).

Figure 11:
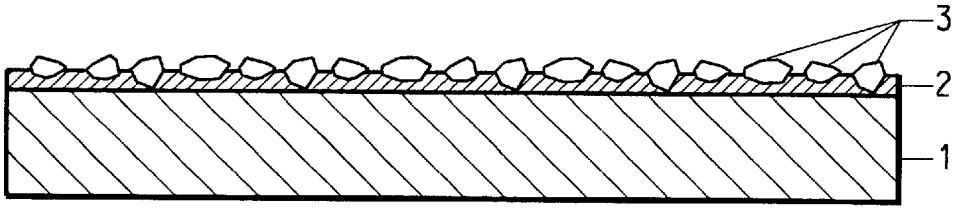

As shown schematically in FIG. 11, the product is substrate 1 coated with a thin layer of the metal 2 with the annealed carbon spot 3 embedded therein and anchored to the substrate. Such a product is suitable for use as a field emitter cathode.

The following non-limiting examples are provided to further illustrate, enable and describe the invention. In the following examples, the flat-plate emission measurement unit or the coated wire emission measurement unit described above were used to obtain emission characteristics for these materials.

EXAMPLE 1 AND COMPARISON EXPERIMENT A

Annealed carbon soot was prepared for use in Example 1. Carbon soot was prepared by using graphite electrodes with diameters of 8 mm and 12 mm for the anode and cathode, respectively. The atmosphere in the chamber was helium at a pressure of about 150 torr, and the current between the electrodes during the arc-discharge experiment was about 125 amps. A computer-controlled motor was used to adjust the position of the anode with respect to the cathode. During the arc-discharge process, the anode was consumed, a carbonaceous growth occurred on the cathode, and the motor controls the distance between the anode and the cathode to approximately 1 mm, maintaining a voltage of 20 to 30 volts between the electrodes. Carbon soot was deposited on the walls of the chamber, from where it is scraped off, and on a filter placed en route to a pump that controlled the chamber pressure, from where it was collected. The soot from the chamber walls and from the filter was annealed to produce the emissive material. A portion of the carbon soot so produced, i.e., the unannealed carbon soot, was set aside for the electron emission measurements of Comparison Example A. The electron microscopy images of FIGS. 1 and 2 discussed above were obtained using this unannealed carbon soot.

The annealing process used to produce the annealed carbon soot used in the Example 1 was as follows. The carbon soot was placed in a graphite crucible and heated in flowing argon. The temperature was increased at a rate of 25° C. per minute to 1,700° C. The temperature was maintained at 1,700° C. for one hour and then raised at 25° C. per minute to 2,500° C. It was maintained at 2,500° C. for 1 hour after which the power to the furnace was turned off and the carbon soot was allowed to cool in the furnace to room temperature. The furnace used normally took about an hour to cool to room temperature and the annealed carbon soot was then removed from the furnace. The electron microscopy images of FIGS. 3 and 4 discussed above were obtained using this annealed carbon soot.

For Comparison Experiment A, a portion of the unannealed carbon soot was placed on the adhesive side of copper tape and two additional pieces of copper tape were used to hold the copper tape on the cathode plate of the emission measurement unit (Measurement Unit I). The separation distance of the electrodes was 0.19 cm. The voltage was increased to 3000 volts ($E=1.6\times10^6$ V/m) and no emission was observed.

For Example 1, the annealed carbon soot was placed on the adhesive side of copper tape and two additional pieces of conducting copper tape were used to hold the copper tape on the cathode plate of the emission measurement unit (Measurement Unit I). The separation distance of the electrodes was 0.19 cm. The voltage was increased to 3000 volts ($E=1.6\times10^6$ V/m) and emission current was observed. At 1500 volts ($E=8\times10^5$ V/m), the current was 9.25 $\mu$A and at 3000 volts ($E=1.6\times10^6$ V/m), the current was 26.7 $\mu$A.

The results show that unannealed carbon soot did not emit up to 3000 volts while annealed carbon soot from the same source did emit at voltages less than 3000 volts.

EXAMPLES 2–5

The carbon soot used in Examples 2–5 was prepared by the same process as described in Example 1 except that for these experiments the atmosphere in the chamber was helium at a pressure of about 500 torr.

The annealing process used to produce the annealed carbon soot used in the Examples 2–5 was as follows. The carbon soot was placed in a graphite crucible and heated in flowing argon. The temperature was increased at a rate of 25° C. per minute to 2,500° C. The carbon soot was maintained at 2,500° C. for 15 minutes for the sample of Example 2, for 30 minutes for the sample of Example 3, for 1 hour for the sample of Example 4, and for 2 hours for the sample of Example 5, and cooled in the furnace to room temperature as described in Example 1. The annealed carbon soot was then removed from the furnace.

The annealed carbon soot sample of each example was, in-turn, placed on the adhesive side of copper tape and two additional pieces of conducting copper tape were used to hold the copper tape on the cathode plate of the emission measurement unit (Measurement Unit II). The separation distance of the electrodes was 0.055 cm. A voltage was applied and the emission current was measured.

For the sample of Example 2, at 500 volts ($E=9\times10^5$ V/m), the current was 5.37 $\mu$A; at 800 volts ($E=1.5\times10^6$ V/m), the current was 14.1 $\mu$A; at 1300 volts ($E=2.4\times10^6$ V/m), the current was 113.5 $\mu$A.

For the sample of Example 3, at 600 volts ($E=1\times10^6$ V/m), the current was 6.32 $\mu$A; at 900 volts ($E=1.6\times10^6$ V/m), the current was 14.1 $\mu$A; at 1300 volts ($E=2.4\times10^6$ V/m), the current was 94.9 $\mu$A; at 1400 volts ($E=2.5\times10^6$ V/m), the current was 110.2 $\mu$A.

For the sample of Example 4, at 700 volts ($E=1.3\times10^6$ V/m), the current was 5.79 $\mu$A; at 900 volts ($E=1.6\times10^6$ V/m), the current was 33.0 $\mu$A; at 1300 volts ($E=2.4\times10^6$ V/m), the current was 62.1 $\mu$A; at 1400 volts ($E=2.5\times10^6$ V/m), the current was 79.6 $\mu$A.

For the sample of Example 5, at 354 volts ($E=6.4\times10^5$ V/m), the current was 4.79 $\mu$A; at 850 volts ($E=1.5\times10^6$ V/m), the current was 35.4 $\mu$A; at 1000 volts ($E=1.8\times10^6$ V/m), the current was 97.8 $\mu$A.

Figure 5:
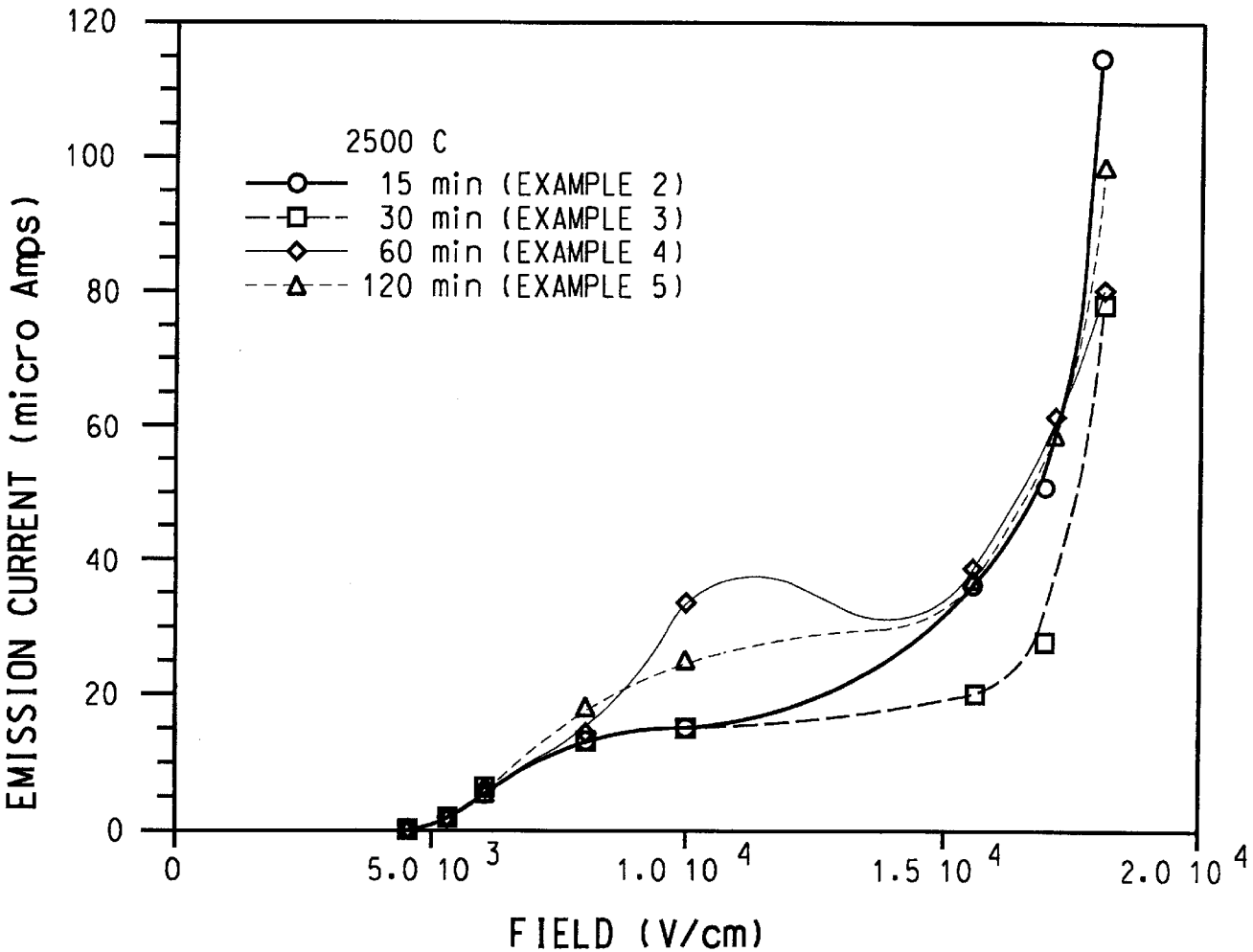
FIG. 5 shows plots of the electron emission results for four annealed carbon soot samples (Examples 2–5) annealed at 2500° C. for different amounts of time.

The emission results for Examples 2–5 are plotted in FIG. 5. The results show that at 2500° C. the time of annealing is not critical.

EXAMPLES 6–9

Carbon soot was prepared substantially as described in Examples 2–5. However, the annealing process used to produce the annealed carbon soot used in Examples 6–9 was as follows. Carbon soot was placed in a graphite crucible and heated in flowing argon. The temperature was increased at a rate of 25° C. per minute to 2,850° C. The soot was maintained at 2,850° C. for 15 minutes for the sample of Example 6, for 30 minutes for the sample of Example 7, and for 1 hour for the sample of Example 8, and 2 hours for the sample of Example 9 and then cooled in the furnace to room temperature as described in Example 1. The annealed carbon soot was then removed from the furnace.

The annealed carbon soot sample for each example was, in-turn, placed on the adhesive side of copper tape and two additional pieces of conducting copper tape were used to hold down the copper tape on the cathode plate of the emission measurement unit. The separation distance of the electrodes was 0.19 cm. A voltage was applied and the emission current was measured (Measurement Unit I).

For the sample of Example 6, at 300 volts ($E=1.6\times10^5$ V/m), the current was 4.57 $\mu$A; at 500 volts ($E=2.6\times10^5$ V/m), the current was 34.8 $\mu$A; at 650 volts ($E=3.4\times10^5$ V/m), the current was 146.9 $\mu$A.

For the sample of Example 7, at 1500 volts ($E=8\times10^5$ V/m), the current was 1.1 $\mu$A and at 3000 volts ($E=1.6\times10^6$ V/m), the current was 13.1 $\mu$A.

For the sample of Example 8, at 1500 volts ($E=8\times10^5$ V/m), the current was 11.1 $\mu$A and at 2500 volts ($E=1.3\times10^6$ V/m), the current was 43.0 $\mu$A.

For the sample of Example 9, at 1500 volts ($E=8\times10^5$ V/m), the current was 1.88 $\mu$A and at 2000 volts ($E=1.6\times10^6$ V/m), the current was 4.39 $\mu$A.

Figure 6:
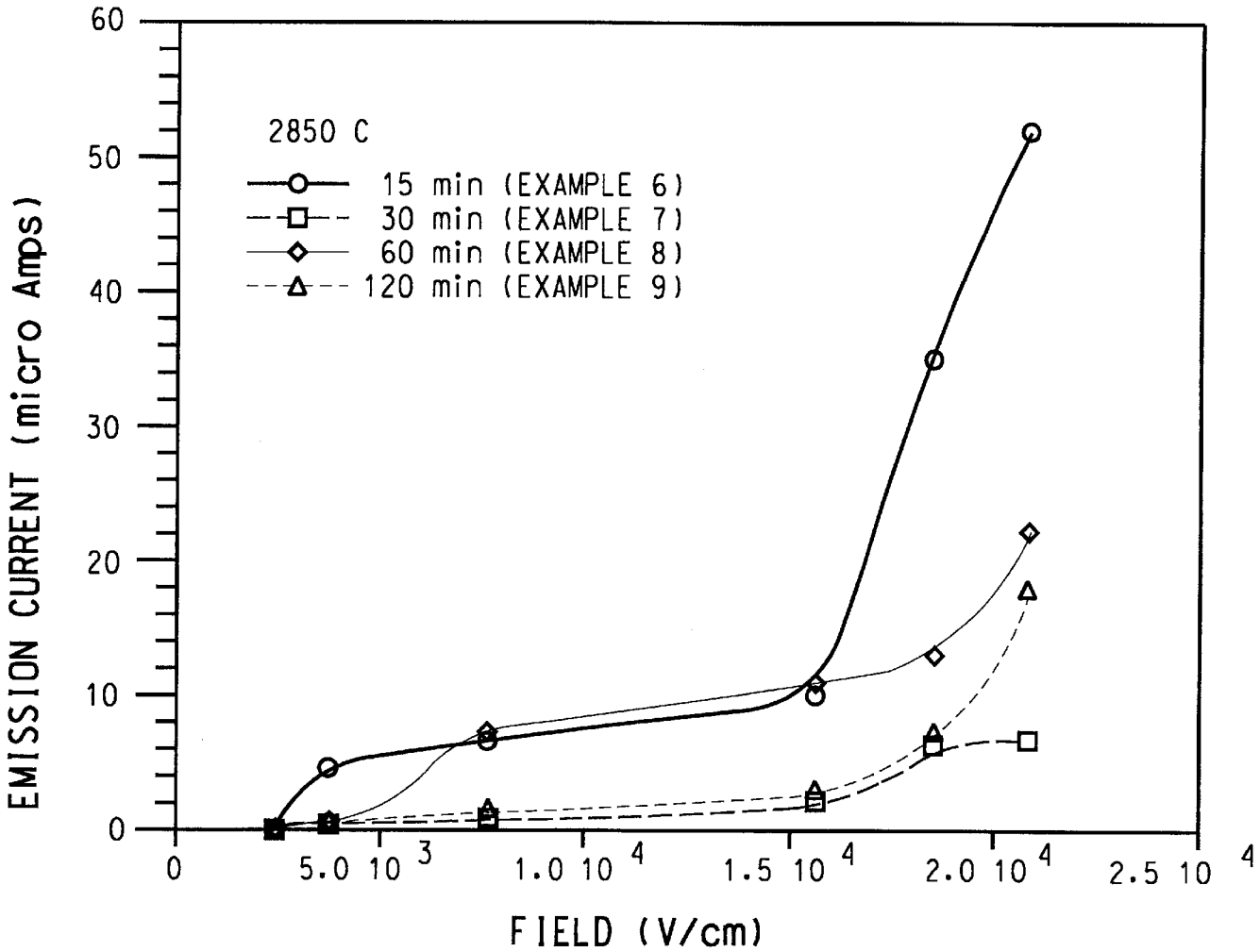
FIG. 6 shows plots of the electron emission results for four annealed carbon soot samples (Examples 6–9) annealed at 2850° C. for different amounts of time.

The emission results for Examples 6–9 are plotted in FIG. 6. The results show that at 2850° C. the increased time of annealing decreases emission. This is most probably due to the increased agglomeration of the particles at high temperature. Moreover, increasing the annealing temperature decreases emission slightly, again probably due to agglomeration of the particles.

Total annealing time appears to be critical at higher temperatures. Higher temperature annealing is preferred provided total time of annealing is relatively short (e.g., higher emission results were obtained when the carbon soot was annealed without the intermediate 1700° C. step and heated to 2850° C. in a short time and soaked at that temperature for a short period of time.

EXAMPLES 10 AND 10A

A method for attaching annealed carbon soot particles to a substrate to provide a field emitter cathode is described in Example 10 in which annealed carbon soot particles were attached to a 100 nm film of silver which had been sputtered onto a glass slide.

Carbon soot was prepared substantially as described in Examples 2–5 above. The annealing process was the same as in Example 6.

A 100 nm silver film was sputtered onto a 1 in×0.5 in (2.5 cm×1.3 cm) glass slide. The silver was sputtered at a deposition rate of 0.4 nm/s in an argon atmosphere using a Denton 600 (Denton Company, Cherry Hill, N.J.) sputtering unit. The glass slide containing the sputtered silver film served as the substrate for the annealed carbon soot field emission particles.

A solution containing 25 wt % silver nitrate ($AgNO_3$), 3 wt % polyvinyl alcohol (PVA) and 71.9 wt % water was prepared by adding 3 g of PVA, M.W. 86,000, (Aldrich, Milwaukee, Wis.) to 72 g of boiling $H_2O$ and stirring for about 1 hour to completely dissolve the PVA. 25 g of $AgNO_3$ (EM Science, Ontario, N.Y.) were added to the PVA solution at ambient temperature and the solution was stirred to dissolve the $AgNO_3$. 0.1 wt % of a fluorinated surfactant, ZONYL® FSN (E. I. du Pont de Nemours and Company, Wilmington, Del.) was also added to the solution to improve the wetting of the solution to the silver film.

Figure 7:
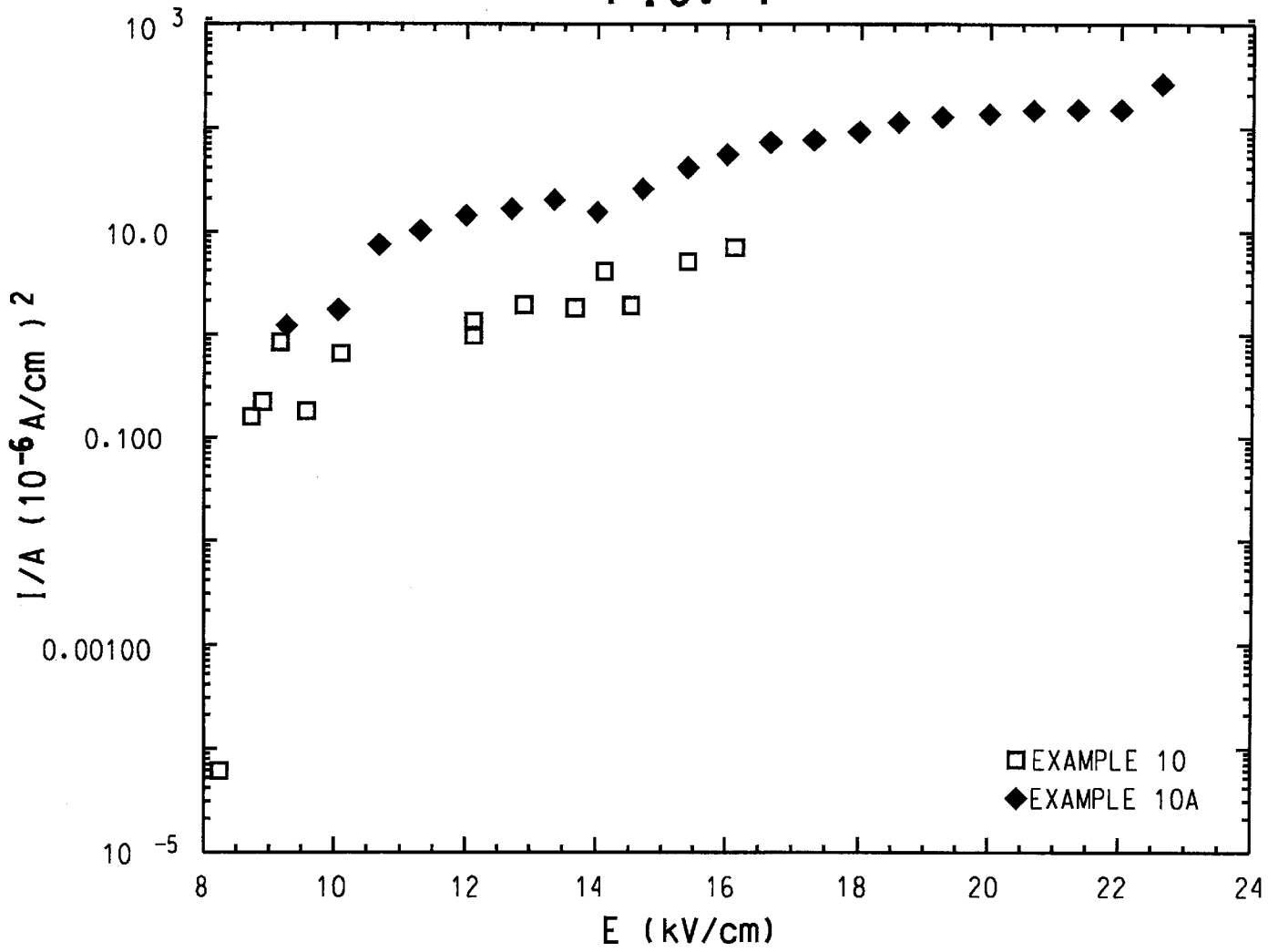
FIG. 7 shows plots of the electron emission results for two different annealed carbon soot samples (Examples 10 and 10A).

The PVA/$AgNO_3$/ZONYL® FSN solution was applied to the silver film using a #3 wire rod (Industry Technology, Oldsmar, Fla.). The annealed carbon soot was sprinkled through a 0.1 mil (30 micron) silk screen uniformly onto the wet PVA/$AgNO_3$/ZONYL® FSN surface. When the surface was completely covered with annealed carbon soot, the glass slide substrate containing the wet PVA/$AgNO_3$/ZONYL® FSN film covered with annealed carbon soot was placed in a quartz boat which was then positioned in the center of a tube furnace. Heating was carried out in a reducing atmosphere comprised of 2% hydrogen and 98% argon. The temperature was increased at a rate of 14° C. per minute to 140° C. and this temperature was maintained for one hour. The sample was allowed to cool to room temperature in the furnace in the same reducing atmosphere and was then removed form the furnace. The reduced silver metal provided a thin silver film layer which attached and anchored the annealed carbon soot to the sputtered silver film of the substrate and resulted in an electron emitter which was suitable for use as field emitter cathode. The electron emission was measured using the flat-plate emission measurement unit described previously as Measurement Unit I. FIG. 7 shows a plot of the emission results which were measured with an electrode separation distance of 2.49 mm.

In Example 10A, some of the annealed carbon soot used in Example 10 was attached to the adhesive side of copper adhesive tape (commercially available from Electrolock, Inc., Chagrin Falls, Ohio) by directly sprinkling the annealed carbon soot particles onto the adhesive side of the copper tape. The flat-plate emission measurement unit (Measurement Unit I) was used to measure the electron emission of this sample of annealed carbon soot. An electrode separation distance of 1.5 mm was used and this data is also shown in FIG. 7. Comparison of the data for Examples 10 and 10A shows that the emissivity of the annealed carbon soot is not reduced considerably by the wet processing and firing procedure.

Figure 8:
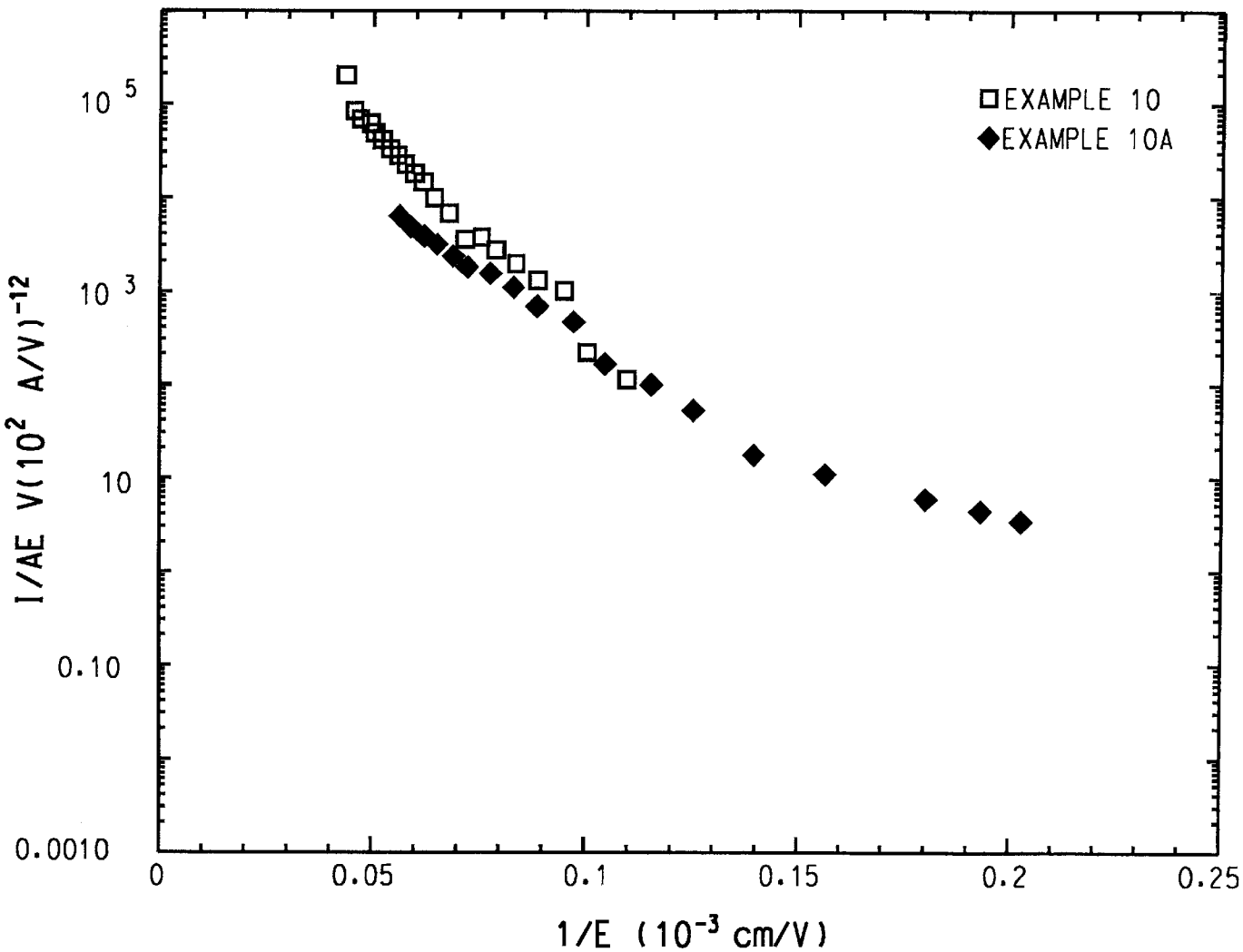
FIG. 8 shows the same data as in FIG. 7 except as Fowler-Nordheim plots.

FIG. 8 shows the same data as FIG. 7 except as Fowler-Nordheim plots.

EXAMPLES 11–13

A method for attaching annealed carbon soot particles to a metal wire using a thin silver layer and thereby providing a field emitter cathode is described in Examples 11–13. Carbon soot was prepared substantially as described above in Examples 2–5. The annealing process was the same as in Example 6.

The wires used in these examples to support the annealed carbon soot were all cleaned by immersing the wires in a 5% $HNO_3$ solution for one minute followed by rinsing with abundant water and then rinsing with acetone and methanol.

In Example 11, a solution containing 25 wt % silver nitrate ($AgNO_3$), 3 wt % polyvinyl alcohol (PVA) and 72 wt % water was prepared by adding 3 g of PVA, M.W. 86,000, (Aldrich, Milwaukee, Wis.) to 72 g of boiling $H_2O$ and stirring for about 1 hour to completely dissolve the PVA. 25 g of $AgNO_3$ (EM Science, Ontario, N.Y.) were added to the PVA solution at ambient temperature and the solution was stirred to dissolve the $AgNO_3$.

A 4 mil (100 $\mu$m) copper wire was dipped into the PVA/$AgNO_3$ solution and then immersed into the annealed carbon soot. When the surface of the wire was completely covered with annealed carbon soot, the wire was placed in a quartz boat which was then positioned in the center of a tube furnace and fired as previously described.

In Examples 12 and 13, a solution containing 25 wt % silver nitrate ($AgNO_3$), 3 wt % polyvinyl alcohol (PVA), 0.5 wt % of a fluorinated surfactant, ZONYL® FSN and 71.5 wt % water was prepared by adding 3 g of PVA, M.W. 86,000, (Aldrich, Milwaukee, Wis.) to 71.5 g of boiling $H_2O$ and stirring for about 1 hour to completely dissolve the PVA. 25 g of $AgNO_3$ (EM Science, Ontario, N.Y.) were added to the PVA solution at ambient temperature and the solution was stirred to dissolve the $AgNO_3$. 0.5 g of a fluorinated surfactant, ZONYL® FSN (E. I. du Pont de Nemours and Company, Wilmington, Del.) was added to the solution to improve the wetting of the solution to the wire.

In Example 12, a 4 mil (100 $\mu$m) copper wire was immersed into the PVA/$AgNO_3$/ZONYL® FSN solution and then immersed in the annealed carbon soot. When the surface of the wire was completely covered with annealed carbon soot, the wire was placed in a quartz boat which was then positioned in the center of a tube furnace.

In Example 13, a 4 mil (100 $\mu$m) copper wire was immersed in the PVA/$AgNO_3$/ZONYL® FSN solution and then immersed in the annealed carbon soot. When the surface of the wire was completely covered with annealed carbon soot, a thin liquid coating of the PVA/$AgNO_3$/ZONYL® FSN solution used in Example 12 was used to coat the annealed carbon soot particles using a nebulizer head (Model 121—Sono-Tek Corporation, Poughkeepsie, N.Y.) that produced a fine mist comprised of micron diameter droplets. The solution was delivered to the nebulizer head by a syringe pump at the rate of 18 $\mu$L/s for about 30 seconds. During the time of deposition, the wire was translated and rotated to provide uniform coverage with the solution. The wire was then placed in a quartz boat which was positioned in the center of a tube furnace.

In all three examples, firing was carried out in a reducing atmosphere comprised of 2% hydrogen and 98% argon. The temperature was increased at a rate of 14° C. per minute to 140° C. and this temperature was maintained for one hour. Each sample was allowed to cool to room temperature in the furnace in the same reducing atmosphere and was then removed form the furnace. In each example, the reduced silver metal provided a thin silver film layer which coated the wire and attached the annealed carbon soot to the wire and resulted in an electron emitter which was suitable for use as a field emitter cathode. The electron emission was measured using the cylindrical emission measurement unit described previously as Measurement Unit III.

Figure 9:
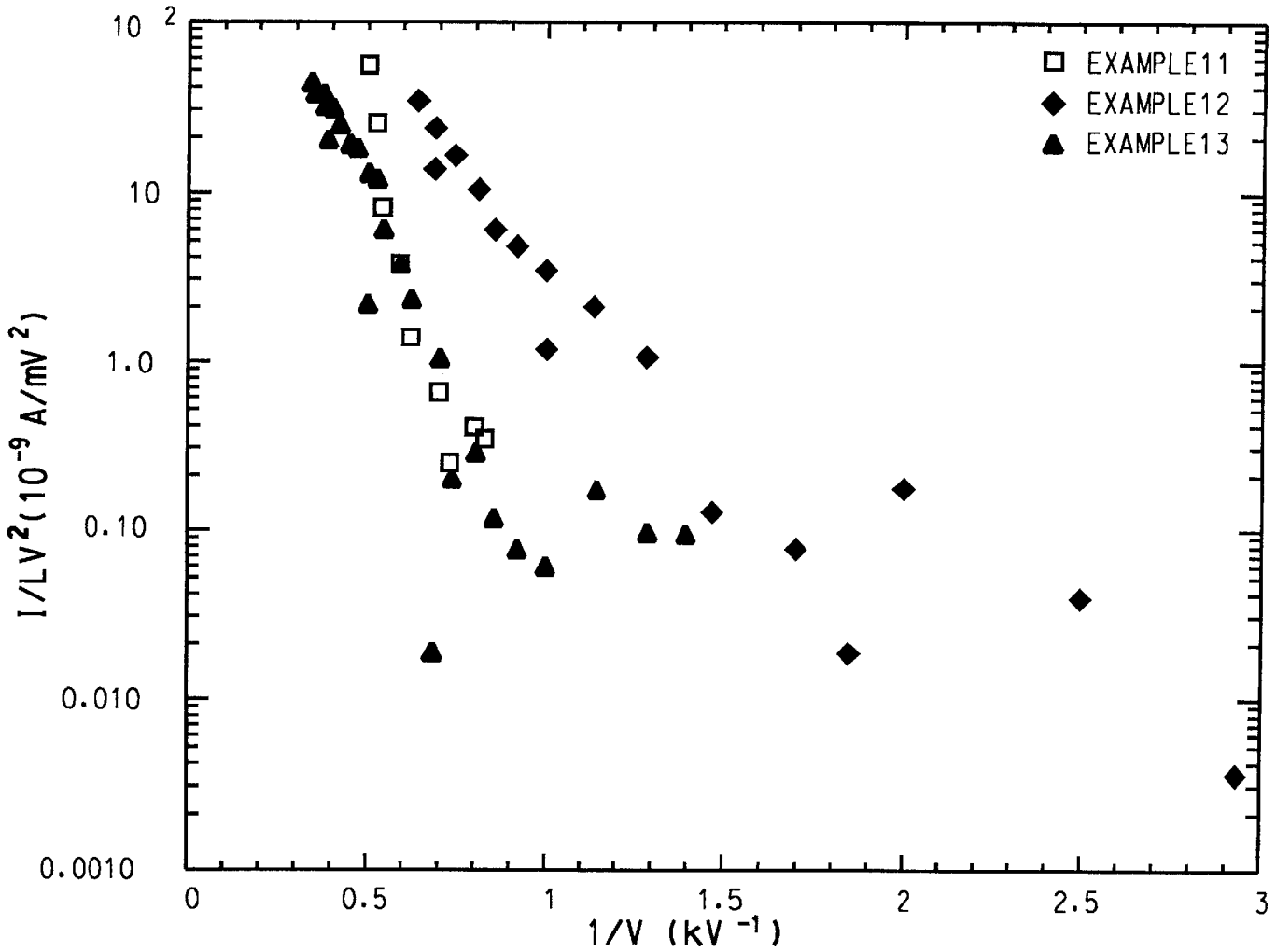
FIG. 9 shows the Fowler-Nordheim plots of the electron emission results for three annealed carbon soot samples (Examples 11–13) using silver as an attachment material.

This data is shown in FIG. 9 wherein Example 12 shows higher emission, presumably due to higher particle density on the wire due to higher $AgNO_3$ wetting to the copper wire which, in-turn, allows more particles to adhere to the wire surface. Example 13 shows that top coating decreases the emissivity of the particles although it increases the anchoring effect of the particles to the wire.

EXAMPLES 14–16

A method for attaching annealed carbon soot particles to metal wires using a thin gold layer, thereby providing a field emitter cathode, is described in Examples 14–16. Carbon soot was prepared substantially as in Examples 2–5. The annealing process was the same as in Example 6.

The wires used in these examples to support the annealed carbon soot were all cleaned by immersing the wires in a 3% $HNO_3$ solution for one minute followed by rinsing with abundant water and then rinsing with acetone and methanol.

In Example 14, gold dispersed in an organic base (Aesar 12943, Ward Hill, Mass.) was brushed onto a 5 mil (125 $\mu$m) tungsten wire according to the manufacturer's suggestions. Annealed carbon soot was deposited onto the wire covered with the gold compound through a 100 micron sieve. When the surface of the wire was completely covered with annealed carbon soot, the wire was placed in a quartz boat which was then placed in a furnace.

Heating was carried out in an atmosphere of air. The temperature was increased at a rate of 25° C. per minute to 540° C. and this temperature was maintained for 30 minutes to burn off all organic materials. The sample was allowed to cool to room temperature in the furnace and was then removed from the furnace. The gold metal provided a thin gold film which coated the wire and attached the annealed carbon soot to the wire and resulted in an electron emitter which was suitable for use as a field emitter cathode.

In Example 15, a sample was prepared essentially as described for Example 14 except that after the sample was removed from the furnace, a 50 nm layer of diamond-like carbon was deposited on the surface to further seal the structure by laser ablation of a graphite target. Additional description on coating a fiber or wire with diamond-like-carbon via laser ablation can be found in Davanloo et al., J. Mater. Res., Vol. 5, No. 11, November 1990 and in pending in U.S. Application Ser. No. 08/387,539 filed Feb. 13, 1995, (Blanchet-Fincher et al.) entitled "Diamond Fiber Field Emitters", the entire contents of which are incorporated herein by reference. A 264 nm wave length laser beam was used to make an incident angle of 45° to a graphite target located at the center of the ablation chamber. Laser pulses of 10 nanoseconds with a 2 Hz repetition rate were used. An energy density of 4 J/cm$^2$ was maintained for 1 minute and the laser beam was rastered onto the target with a pair of motorized micrometers. The ablation chamber was maintained at $2\times10^{-7}$ torr ($2.67\times10^{-5}$ Pascal). The wire used was 5 cm away from the target along the direction normal to the target.

In Example 16, a sample was prepared essentially as described for Example 14 except that a 4 mil (100) $\mu$m copper wire was used in place of the tungsten wire.

Figure 10:
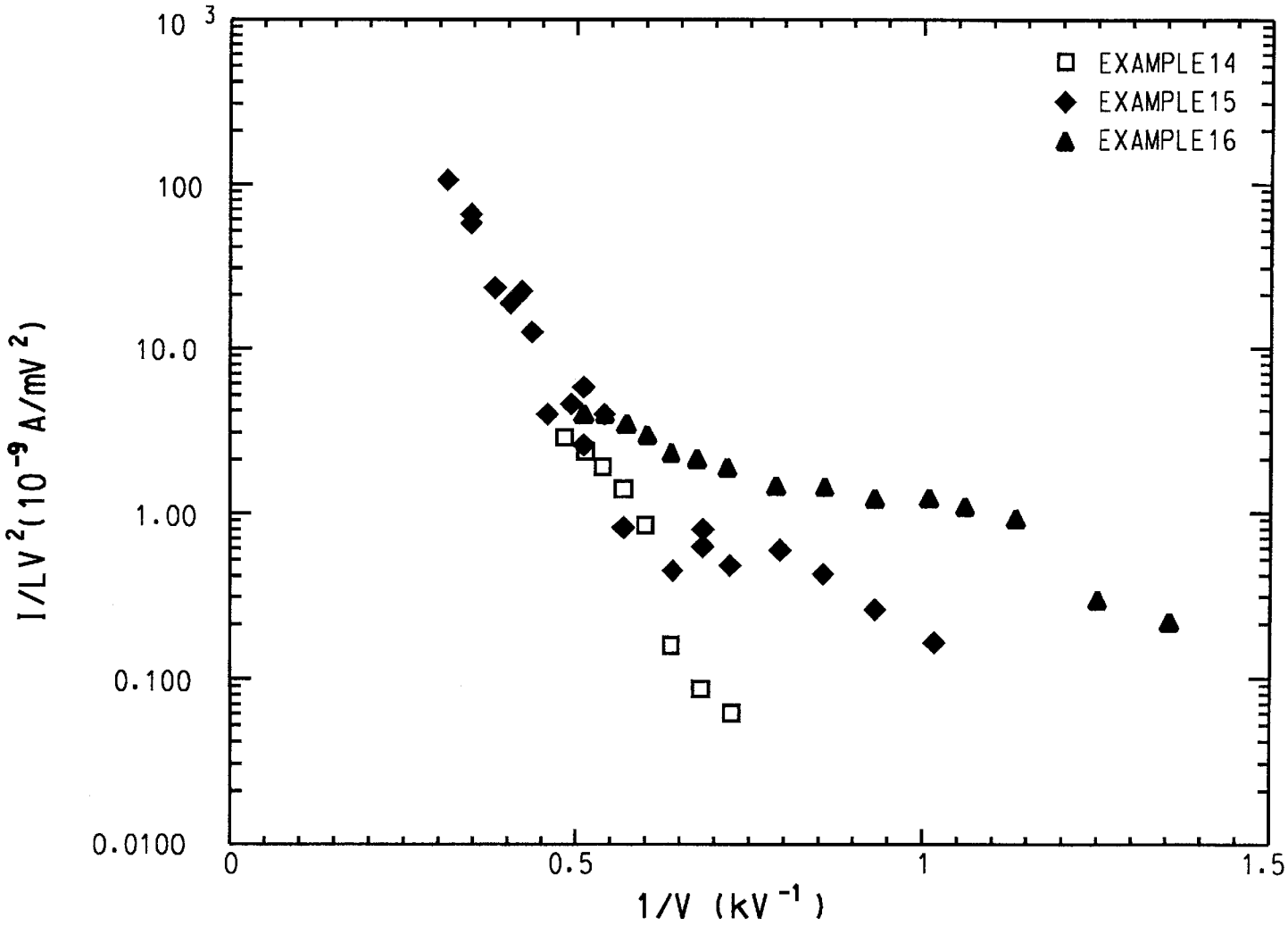
FIG. 10 shows the Fowler-Nordheim plots of the electron emission results for three annealed carbon soot samples (Examples 14–16) using gold as an attachment material.

The electron emission of all three samples was measured using the cylindrical emission measurement unit described previously as Measurement Unit III. This data is shown in FIG. 10 and indicates that emission occurs on different wires with or without top coats.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A field emission emitter comprising annealed carbon soot.

2. The field emission emitter of claim 1 wherein the annealed carbon soot has a particle size less than about 20 $\mu$m.

3. The field emission emitter of claim 1 wherein the annealed carbon soot has a particle size less than 1 $\mu$m.

4. The field emission emitter of claim 2 wherein the annealed carbon soot has a particle size between about 5 nm to about 15 nm.

5. A field emission cathode comprised of annealed carbon soot attached to the surface of a substrate.

6. The field emission cathode of claim 5 wherein the substrate is planar.

7. The field emission cathode of claim 5 wherein the substrate is a fiber.

8. The field emission cathode of claim 5 wherein the substrate is a metal wire.

9. The field emission cathode of claim 8 wherein the metal wire is nickel.

10. The field emission cathode of claim 8 wherein the metal wire is tungsten.

11. The field emission cathode of claim 8 wherein the metal wire is copper.

* * * * *